US011426018B2

(12) United States Patent
Leinbach

(10) Patent No.: US 11,426,018 B2
(45) Date of Patent: Aug. 30, 2022

(54) BUILDABLE DRINKING STRAW

(71) Applicant: Amy Lisa Gross Leinbach, Huntington Beach, CA (US)

(72) Inventor: Amy Lisa Gross Leinbach, Huntington Beach, CA (US)

( * ) Notice: Subject to any disclaimer, the term of this patent is extended or adjusted under 35 U.S.C. 154(b) by 58 days.

(21) Appl. No.: 16/896,954

(22) Filed: Jun. 9, 2020

(65) Prior Publication Data

US 2020/0390257 A1 Dec. 17, 2020

Related U.S. Application Data

(60) Provisional application No. 62/859,875, filed on Jun. 11, 2019.

(51) Int. Cl.
*A47G 21/18* (2006.01)

(52) U.S. Cl.
CPC ..... *A47G 21/189* (2013.01); *A47G 21/18* (2013.01); *A47G 21/186* (2013.01)

(58) Field of Classification Search
CPC ..... A47G 21/18; A47G 21/186; A47G 21/189
USPC ..... 239/33
See application file for complete search history.

(56) References Cited

U.S. PATENT DOCUMENTS

| | | | | |
|---|---|---|---|---|
| 2,192,037 | A * | 2/1940 | Hamilton | B65D 77/283 239/33 |
| 2,646,311 | A * | 7/1953 | Jones | A47G 21/18 239/33 |
| 3,189,171 | A * | 6/1965 | Miller | A47G 21/189 239/33 |
| 4,736,887 | A * | 4/1988 | Inaba | A47G 21/189 239/33 |
| 10,123,641 | B1 * | 11/2018 | Pepper | B08B 1/005 |
| 2012/0138622 | A1 * | 6/2012 | Slansky | A47G 21/18 239/33 |
| 2020/0077823 | A1 * | 3/2020 | Burns | A47G 21/18 |

* cited by examiner

*Primary Examiner* — Steven J Ganey
(74) *Attorney, Agent, or Firm* — Kunzler Bean & Adamson

(57) ABSTRACT

Apparatuses, systems, and methods are presented for a buildable drinking straw. A segment of a drinking straw is hollow. A segment has a narrow end and a wider end. A wider end of a segment of a drinking straw is opposite a narrow end of the segment of the drinking straw and has a wider diameter than the narrow end of the segment of the drinking straw so that the segment of the drinking straw tapers in diameter from the wider end to the narrow end of the segment of the drinking straw.

14 Claims, 5 Drawing Sheets

BUILDABLE DRINKING STRAW

CROSS-REFERENCES TO RELATED APPLICATIONS

This application claims the benefit of U.S. Provisional Patent Application No. 62/859,875 entitled "BUILDABLE DRINKING STRAW" and filed on Jun. 11, 2019 for Amy Lisa Gross Leinbach, which is incorporated herein by reference in its entirety for all purposes.

TECHNICAL FIELD

This disclosure relates to drinking straws and more particularly relates to a segmented, buildable, drinking straw.

BACKGROUND

Traditional drinking straws are often too tall for children, causing children's cups to tip and/or spill. Reusable straws can also be difficult to clean, difficult to determine whether they are clean, and inconvenient to carry around.

SUMMARY

Apparatuses are presented for a buildable drinking straw. In one embodiment, a segment of a drinking straw is hollow. A wider end of a segment of a drinking straw, in certain embodiments, is opposite a narrow end of the segment of the drinking straw. A wider end of a segment of a drinking straw, in a further embodiment, has a wider diameter than a narrow end of the segment of the drinking straw so that the segment of the drinking straw tapers in diameter from the wider end to the narrow end of the segment of the drinking straw.

Other apparatuses for a buildable drinking straw are presented. In one embodiment, an apparatus includes means for multiple segments of a drinking straw. An apparatus, in certain embodiments, includes means for coupling narrow ends of one or more of multiple segments to wider ends of the multiple segments to form a drinking straw. Wider ends of a segment of a drinking straw, in a further embodiment, have a wider diameter than narrow ends so that the segment of the drinking straw tapers in diameter from the wider end to the narrow end.

Systems are presented for a buildable drinking straw. In one embodiment, a plurality of substantially straight segments of a drinking straw are hollow and taper from a wider end of each segment to a narrow end of each segment so that the wider ends have a wider diameter than the narrow ends. One or more bent segments of a drinking straw, in certain embodiments, each have a bend forming a non-straight angle.

Reference throughout this specification to features, advantages, or similar language does not imply that all of the features and advantages that may be realized with the present disclosure should be or are in any single embodiment of the disclosure. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the disclosure may be practiced without one or more of the specific features or advantages of a particular embodiment. In other instances, additional features and advantages may be recognized in certain embodiments that may not be present in all embodiments of the disclosure.

These features and advantages of the present disclosure will become more fully apparent from the following description and appended claims or may be learned by the practice of the disclosure as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the disclosure will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment.

Furthermore, the described features, structures, or characteristics of the disclosure may be combined in any suitable manner in one or more embodiments. In the following description, numerous specific details are provided for a thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
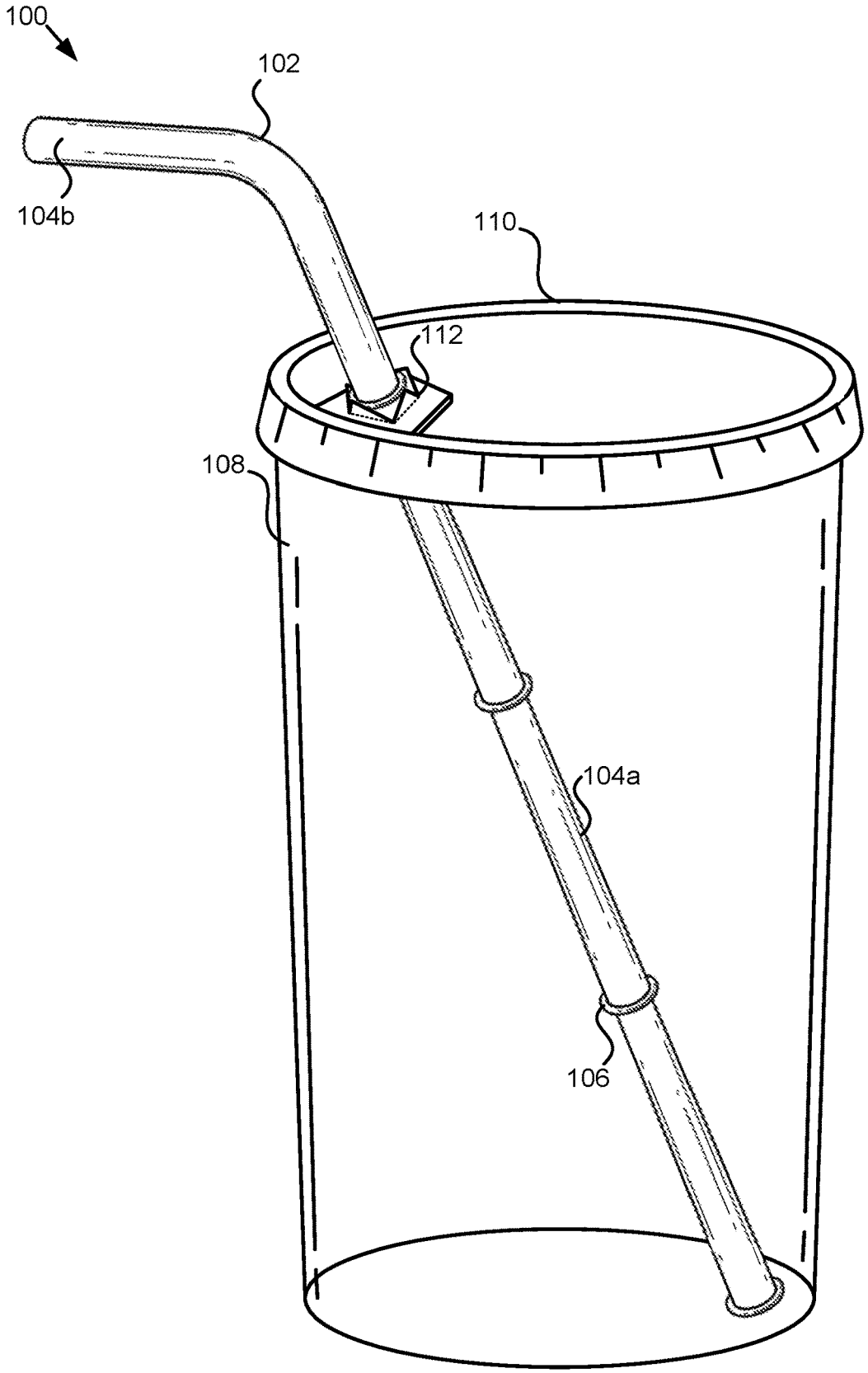
FIG. 1 is a perspective view illustrating one embodiment of a system for a buildable drinking straw.

FIG. 1 depicts one embodiment of a system 100 for a buildable drinking straw 102. In the depicted embodiment, the system 100 includes the buildable drinking straw 102, a drinking cup 108, and a lid 110. The buildable drinking straw 102, in the depicted embodiment, includes a plurality of segments 104 (e.g., one or more straight segments 104*a*, one or more bent segments 104*b*, or the like), one or more of which include a protruding ridge 106.

Because the buildable drinking straw 102 comprises multiple segments 104, in some embodiments, a length of the buildable drinking straw 102 may be customized for use with cups 108 of different heights and/or sizes (e.g., using two segments 104 for a short cup 108, using three segments 104 for a medium cup 108, using four segments 104 for a tall cup 108, using five segments for a taller cup 108, or the like). Segments 104, in various embodiments, may be bundled in sets (e.g., a set of two, a set of three, a set of four, a set of five, a set of six, a set of seven, a set of eight, a set of nine, a set of ten, a set of twelve, a set of sixteen, a set of eighteen, a set of twenty, a set of twenty-four, or the like).

Segments 104 of the buildable drinking straw 102, in one embodiment, may removably couple to other segments 104 with complementary fitting ends (e.g., a friction fit between a narrow end of one segment 104 within a wider end of another segment 104, or the like) allowing a seal to form between segments 104 while also allowing the segments 104 to be easily separated. For example, in certain embodiments, a friction fit between a narrow end and a wider end of different segments 104 may be substantially leak-proof, waterproof, liquid proof, or the like.

One or more of the segments 104 may be hollow and substantially cylindrical and/or tubular and may taper from a wider end to a narrow end (e.g., to allow for the friction fit coupling described above). A narrow end of a segment 104 may be shaped to slide into a wider end of another segment 104. In some embodiments, a wider end of a segment 104 may include an interior wall and/or stop (e.g., substantially and/or completely circumscribing an interior of the wider end of the segment 104) positioned to interface with and/or stop a narrow end of another segment 104 being inserted into the wider end of the segment 104. In other embodiments, a segment 104 is substantially smooth within its hollow interior, and the taper of the segment 104 from the wider end interfaces with and/or stops a narrower end inserted into the wider end.

In the depicted embodiment, a protruding ridge 106 (e.g., a ring, a bump, and/or other raised section of a segment 104) may substantially and/or completely circumscribe a segment 104. A protruding ridge 106 may provide a visual and/or tactile indicator to a user of which end of a segment 104 is a wider end, assisting the user in inserting a narrow end of a different segment 104 into the wider end. A protruding ridge 106, in some embodiments, may also interface with an opening 112 (e.g., a hole 112) in a lid 110 of a cup 108, preventing and/or slowing the drinking straw 102 from sliding through the opening 112 of the lid 110, holding the drinking straw 102 in place, serving as an anchor, preventing the drinking straw 102 from popping in or out of the lid 110, or the like. For example, a user may insert a narrow end of a segment 104 through the opening 112 of the lid 110 prior to putting the segments 104 of the drinking straw 102 together to form the drinking straw 102 (e.g., with the protruding ridge 106 on the outside of the lid 110, on the inside of the lid 110, of the like, depending on which direction of slide most concerns the user).

In the depicted embodiment, several of the segments 104*a* are straight and one or more of the segments 104*b* are bent, forming a non-straight (e.g., greater and/or less than 180 degrees, depending on the point of measurement). For example, a bent segment 104*b* may direct and/or point an end of the drinking straw 102 toward a user (e.g., toward a user's mouth, away from a cup 108 and/or lid 112, or the like), facilitating drinking through the drinking straw 102. In other embodiments, a drinking straw 102 may include all straight segments 104*a* without one or more bent segments 104*b*, may include multiple bent segments 104*b*, or the like.

A width of a hollow opening within segments 104 of a drinking straw 103 (e.g., of a wider end, of a narrow end, or the like) may be selected based on an intended thickness and/or viscosity of a liquid intended to be used with the drinking straw 102. For example, a drinking straw 102 intended for a smoothie, a milkshake, and/or another thicker and/or frozen liquid may have a larger diameter hollow opening than a drinking straw 102 intended for a thinner liquid such as water, soda, juice, punch, milk, or the like.

Segments 104 of a drinking straw 102, in some embodiments, comprise a sturdy and/or durable material, such that the drinking straw 102 is washable, reusable, or the like. In one embodiment, a segment 104 comprises a flexible material (e.g., capable of being deformed and/or bent), an elastomeric material (e.g., a material with viscosity, elasticity, and/or viscoelasticity), or the like, to facilitate a leak-proof friction fit, such as one or more of a polymer, silicone, rubber, polyisoprene (e.g., natural or synthetic rubber), polybutadiene, chloroprene, butyl rubber, styrene-butadiene rubber, nitrile rubber, ethylene propylene rubber, epichlorohydrin rubber, polyacrylic rubber, fluorosilicone rubber, fluoroelastomer, perfluoroelastomer, polyether block amide, chlorosulfonated polyethylene, ethylene-vinyl acetate, thermoplastic elastomer, resilin protein, elastin protein, polysulfide rubber, elastolefin, and/or another material. In other embodiments, a segment 104 may at least partially comprise a material that is inflexible and/or inelastic, such as a metal, wood, hard plastic, glass, fiberglass, ceramic, or the like (e.g., may be partially formed from a substantially inflexible and/or inelastic material with a narrow end and/or wider end at least partially formed of and/or lined with a flexible and/or elastomeric material, or the like). Segments 104, in various embodiments, may be formed by an injection molding process, a drilling process, a lathing process, a three-dimensional printing process, or the like.

While the drinking straws 102 and interchangeable segments 104 described herein may be used for drinking a liquid and/or frozen beverage, in other embodiments, the segments 104 may be used as toys and/or other entertainment. For example, while waiting for a meal or drink (e.g., at a restaurant, at home, in a vehicle, or the like) a child or other user may use the segments 104 as building blocks to form a play structure for entertainment purposes (e.g., as a pleasant distraction while waiting, or the like).

Figure 2:
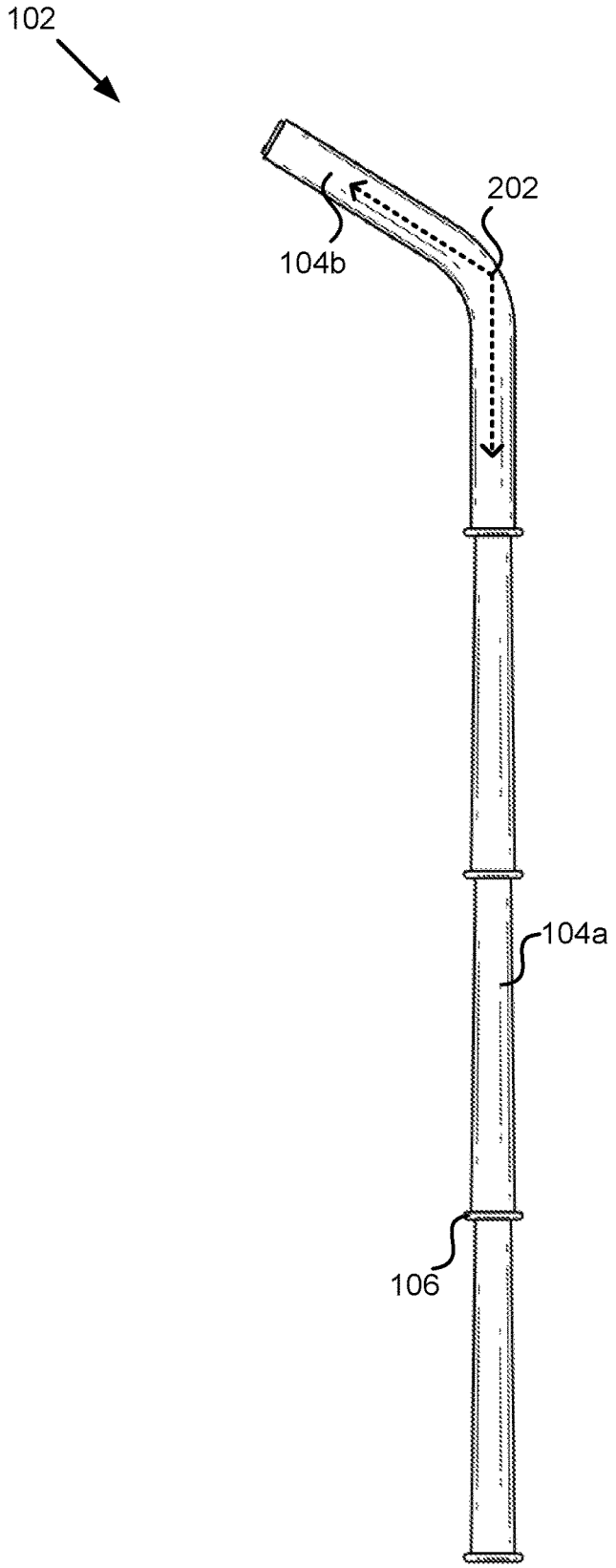
FIG. 2 is a side view illustrating one embodiment of a buildable drinking straw.

FIG. 2 depicts a further embodiment of a buildable drinking straw 102. In certain embodiments, the drinking straw 102 of FIG. 2 may be substantially similar to the drinking straw 102 described above with regard to FIG. 1.

The drinking straw 102 of FIG. 2 comprises a plurality of substantially straight segments 104*a* and one or more bent segments 104*b*.

The one or more bent segments 104*b*, in the depicted embodiment, comprise a bend forming a non-straight angle 202. A non-straight angle 202, as used herein, comprises an angle that is not flat and/or linear, instead being greater than or less than 180 degrees. One or more bent segments 104*b*, in certain embodiments, may facilitate drinking through the drinking straw 102, disposing an end of the drinking straw 102 toward a user (e.g., toward a user's mouth, or the like). In further embodiments, one or more bent segments 104*b* may increase the variety of play structures a child or other user may build using the segments 104*a*, 104*b*. In other embodiments, a drinking straw 102 may consist of exclusively straight segments 104*a*, without any bent segments 104*b*.

Figure 3:
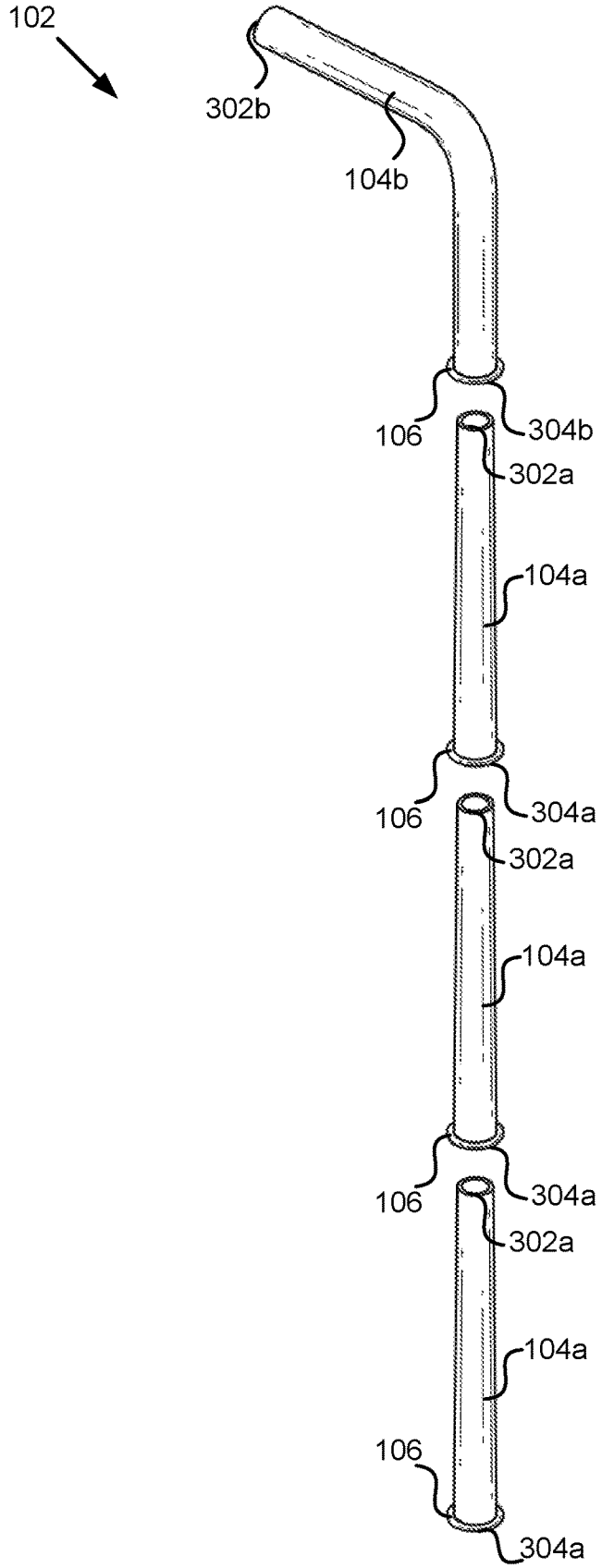
FIG. 3 is an exploded view illustrating one embodiment of a buildable drinking straw.

FIG. 3 depicts an exploded view of a certain embodiment of a buildable drinking straw 102. In certain embodiments, the drinking straw 102 of FIG. 3 may be substantially similar to the drinking straw 102 described above with regard to FIG. 1 and/or the drinking straw 102 described above with regard to FIG. 2.

In the depicted embodiment, a plurality of substantially straight segments 104*a* each have a narrow end 302*a* and a wider end 304*a*, with a wider diameter than the narrow ends 302*a*, providing an interchangeable, removable, friction fit of the narrow ends 302*a* within the wider ends 304*a*, 304*b*. The one or more bent segments 104*b*, in one embodiment, include a wider end 304*b* with a wider diameter than narrow ends of the straight segments 104*a*.

In some embodiments, an opposite end 302*b* of a bent segment 104*b* has a diameter substantially as wide as the wider end 304*b* of the same bent segment 104*b* (e.g., the bent segment 104*b* has little or no tapering between the ends 304*a*, 304*b*). In a further embodiment, a bent segment 104*b* may comprise a narrow end 302*b* with a smaller diameter than a wider end 304*b* of the same bent segment 104*b*, so that the bent segment 104*b* may be removably coupled to another bent segment 104*b*, to a straight segment 104*a*, to two different segments 104, or the like.

Figure 4A:
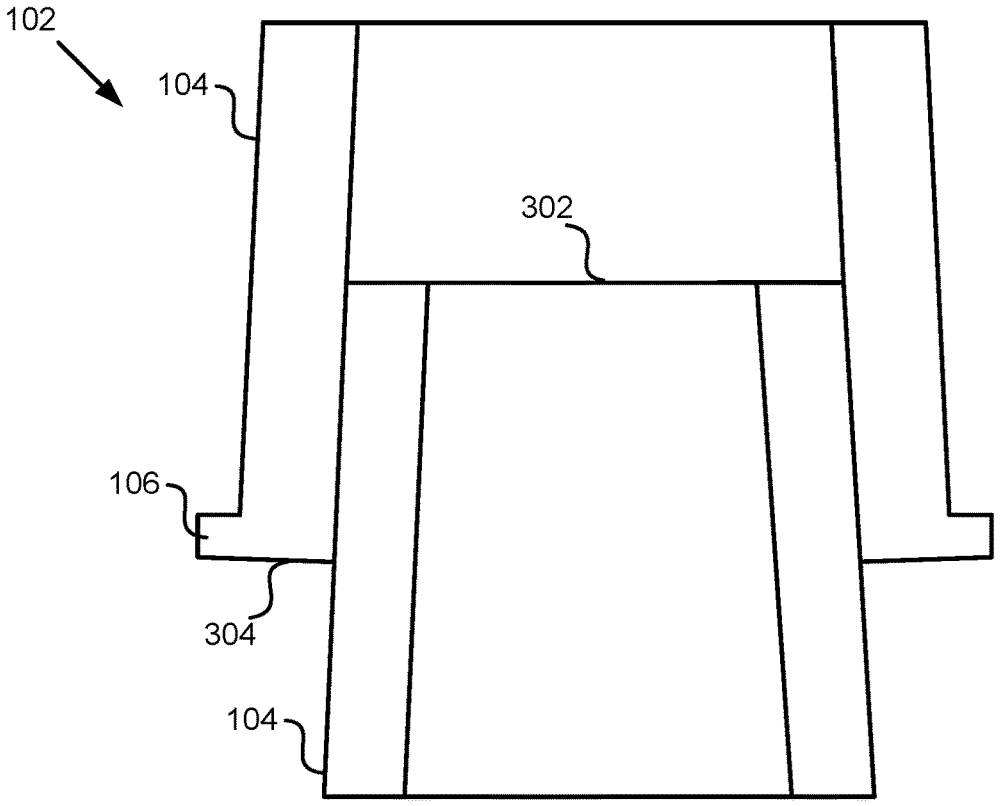
FIG. 4A is a schematic block diagram illustrating one embodiment of a buildable drinking straw.

FIG. 4A depicts one embodiment of a buildable drinking straw 102. In certain embodiments, the drinking straw 102 of FIG. 4A may be substantially similar to the drinking straw 102 described above with regard to FIG. 1, the drinking straw 102 described above with regard to FIG. 2, and/or the drinking straw 102 described above with regard to FIG. 3.

In FIG. 4A, a narrow end 302 of a first segment 104 of the drinking straw 102 has been pushed or otherwise inserted into a wider end 304 of a second segment 104 of the drinking straw 102, forming a removable friction fit between the segments 104. In the depicted embodiment, the wider end 304 comprises a protruding ridge 106 substantially circumscribing the segment 104, but is substantially smooth within the segment 104 (e.g., without an interior stop, bump, ridge, or the like), relying on the tapered angle of the segment 104 to stop insertion of the narrow end 302 and to provide the friction fit.

Figure 4B:
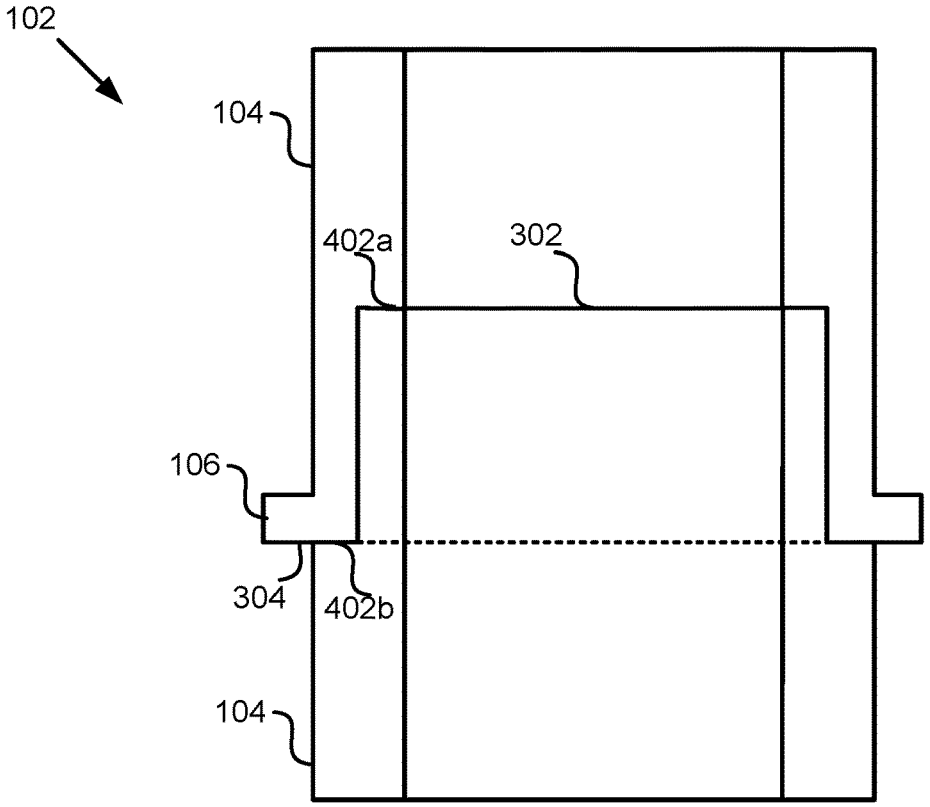
FIG. 4B is a schematic block diagram illustrating a further embodiment of a buildable drinking straw.

FIG. 4B depicts a further embodiment of a buildable drinking straw 102. In certain embodiments, the drinking straw 102 of FIG. 4B may be substantially similar to the drinking straw 102 described above with regard to FIG. 1, the drinking straw 102 described above with regard to FIG. 2, the drinking straw 102 described above with regard to FIG. 3, and/or the drinking straw 102 described above with regard to FIG. 4A, but with complementary cutouts 402*a*, 402*b* rather than a taper.

In FIG. 4B, an interior of a wider end 304 of a first segment 104 comprises a wider cutout 402*a* (e.g., a cavity 402*a*, channel 402*a*, and/or other opening 402*a*) corresponding to a complementary narrower cutout 402*b* in a narrower end 302 of a second segment 104. In this manner, in some embodiments, instead of a taper between a wider end 304 and a narrower end 302 of each segment 104, wider ends 304 and narrower ends 302 may fit together like puzzle pieces, with complimentary cutouts 402, cavities 402, channels 402, and/or other openings 402 allowing a narrower end 302 to fit within a wider end 304, providing a removable friction fit without a taper. In other embodiments, a drinking straw 102 may include both a taper and complementary cutouts 402, or the like.

Figure 5:
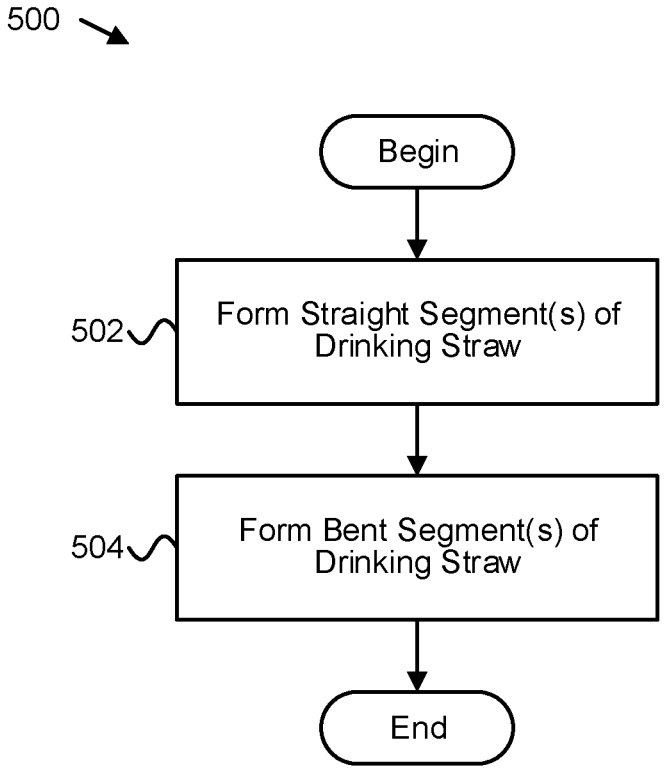
FIG. 5 is a schematic flow chart diagram illustrating one embodiment of a method of manufacturing a buildable drinking straw.

FIG. 5 depicts one embodiment of a method 500 of manufacturing a buildable drinking straw 102. As used herein, a manufacturer may include one or more of a manufacturing hardware machine of other device, a robotic device, a factory device, a hardware and/or software controller for such a device, a user and/or administrator of such a device, or the like.

The method 500 begins and a manufacturer forms 502 one or more straight segments 104*a* of a drinking straw 102. A manufacturer forms 504 one or more bent segments 104*b* of the drinking straw 102 and the method 500 ends.

A means for multiple segments 104 of a drinking straw 125, in various embodiments, may include one or more straight segments 104*a*, one or more bent segments 104*b*, and/or one or more other segments 104 of a drinking straw 125. Other embodiments may include similar or equivalent means for multiple segments 104 of a drinking straw 125.

A means for coupling narrow ends 302 of one or more of multiple segments 104 to wider ends 304 of one or more of the multiple segments 104 to form a drinking straw 125, in various embodiments, may include a friction fit, an adhesive, a narrow end 302, a wider end 304, a protruding ridge 106, a tapered segment 104, complementary cutouts 402*a-b*, and/or another coupling mechanism. Other embodiments may include similar or equivalent means for coupling narrow ends 302 of one or more segments 104 to wider ends 304 of one or more of the multiple segments 104 to form a drinking straw 125.

A means for preventing one of multiple segments 104 from sliding through an opening 112 in a cup 108 lid 110, in various embodiments, may include a protruding ridge 106, a bump, a ring, a raised section, a wider end 304, or the like. Other embodiments may include similar or equivalent means for preventing one of multiple segments 104 from sliding through an opening 112 in a cup 108 lid 110.

A means for disposing an end of a drinking straw 125 toward a user, in various embodiments, may include a bend, a non-straight angle 202, a bent segment 104*b*, or the like. Other embodiments may include similar or equivalent means for disposing an end of a drinking straw 125 toward a user.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus comprising:

a segment of a drinking straw, the segment of the drinking straw being hollow;

a narrow end of the segment of the drinking straw;

a wider end of the segment of the drinking straw, the wider end of the segment of the drinking straw being opposite the narrow end of the segment of the drinking straw and comprising a wider diameter than the narrow end of the segment of the drinking straw such that the segment of the drinking straw tapers in diameter from the wider end to the narrow end of the segment of the drinking straw;

a protruding ridge substantially circumscribing the segment of the drinking straw; and wherein the protruding ridge is disposed toward the wider end of the segment of the drinking straw.

2. The apparatus of claim 1, further comprising a second segment of the drinking straw, a narrow end of the second segment shaped for a removable friction fit within the wider end of the segment of the drinking straw.

3. The apparatus of claim 2, further comprising a third segment of the drinking straw, the third segment of the drinking straw comprising a bend forming a non-straight angle.

4. The apparatus of claim 1, wherein the segment of the drinking straw comprises a flexible material.

5. The apparatus of claim 1, wherein the segment of the drinking straw comprises an elastomeric material.

6. The apparatus of claim 1, wherein the segment of the drinking straw is substantially cylindrical.

7. A system comprising:

a plurality of substantially straight segments of a drinking straw, the substantially straight segments of the drinking straw being hollow and tapering from a wider end of each segment to a narrow end of each segment such that the wider ends comprise a wider diameter than the narrow ends;

one or more bent segments of the drinking straw, the one or more bent segments of the drinking straw each comprising a bend forming a non-straight angle;

one or more protruding ridges substantially circumscribing one or more of the plurality of substantially straight segments and the one or more bent segments of the drinking straw; and wherein the one or more protruding ridges are disposed toward the wider ends of the one or more of the plurality of substantially straight segments and the one or more bent segments of the drinking straw.

8. The system of claim 7, wherein the narrow ends of the plurality of substantially straight segments are shaped for an interchangeable, removable, friction fit within the wider ends of others of the plurality of substantially straight segments and of a wider end of the one or more bent segments of the drinking straw.

9. The system of claim 7, wherein the plurality of substantially straight segments and the one or more bent segments comprise a flexible material.

10. The system of claim 7, wherein the plurality of substantially straight segments and the one or more bent segments comprise an elastomeric material.

11. The system of claim 7, wherein the plurality of substantially straight segments and the one or more bent segments are substantially cylindrical.

12. An apparatus comprising:

multiple segments of a drinking straw;

means for coupling narrow ends of one or more of the multiple segments to wider ends of one or more of the multiple segments to form the drinking straw, the wider ends comprising a wider diameter than the narrow ends such that the multiple segments of the drinking straw taper in diameter from the wider ends to the narrow ends;

means for preventing one of the multiple segments from sliding through an opening in a cup lid; wherein the means for preventing one of the multiple segments from sliding through the opening in the cup lid comprises a protruding ridge substantially circumscribing the one of the multiple segments; and wherein the protruding ridge is disposed toward the wider end of the one of the multiple segments.

13. The apparatus of claim 12, further comprising means for disposing an end of the drinking straw toward a user.

14. The apparatus of claim 13, wherein the means for disposing the end of the drinking straw toward the user comprises a bend in one of the multiple segments, the bend forming a non-straight angle.

* * * * *